US007948510B2

(12) United States Patent
Iwazaki

(10) Patent No.: US 7,948,510 B2
(45) Date of Patent: May 24, 2011

(54) THERMAL PRINTER AND METHOD OF CONTROLLING THE SAME

(75) Inventor: Fumiharu Iwazaki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 71 days.

(21) Appl. No.: 12/555,036

(22) Filed: Sep. 8, 2009

(65) Prior Publication Data

US 2010/0060708 A1 Mar. 11, 2010

(30) Foreign Application Priority Data

Sep. 8, 2008 (JP) ..... 2008-230108

(51) Int. Cl.
*B41J 3/60* (2006.01)
*B41J 2/32* (2006.01)

(52) U.S. Cl. ..... 347/188; 347/193

(58) Field of Classification Search ..... 347/171, 347/188, 193; 400/82, 120.01, 120.09, 120.13, 400/188, 708

See application file for complete search history.

(56) References Cited

U.S. PATENT DOCUMENTS

| | | | | |
|---|---|---|---|---|
| 7,671,878 | B2 * | 3/2010 | Yamada et al. | 347/171 |
| 2007/0273744 | A1 * | 11/2007 | Yamada et al. | 347/204 |
| 2007/0279477 | A1 | 12/2007 | Iwasaki | |
| 2007/0280767 | A1 | 12/2007 | Iwasaki | |
| 2010/0060707 | A1 * | 3/2010 | Baba | 347/218 |
| 2010/0231679 | A1 * | 9/2010 | Masuda | 347/184 |

FOREIGN PATENT DOCUMENTS

| | | | |
|---|---|---|---|
| EP | 1862320 | * | 12/2007 |
| JP | 05-004369 | * | 1/1993 |
| JP | 06-291930 | | 10/1994 |
| JP | 2001-071569 | | 3/2001 |
| JP | 2008-006802 | * | 1/2008 |
| JP | 2009-018593 | * | 1/2009 |

OTHER PUBLICATIONS

Machine-generated translation JP-2001071569, published on Mar. 21, 2001 and cited in the IDS filed on Sep. 8, 2009.*

* cited by examiner

*Primary Examiner* — Huan H Tran
(74) *Attorney, Agent, or Firm* — Turocy & Watson, LLP

(57) ABSTRACT

Detecting a print density for the thermal paper based on the outputs of the first and second mark sensors, and adjusting print densities of the first and second thermal heads according to the detection results.

13 Claims, 8 Drawing Sheets

THERMAL PRINTER AND METHOD OF CONTROLLING THE SAME

CROSS-REFERENCE TO RELATED APPLICATION

This application is based upon and claims the benefit of priority from prior Japanese Patent Application No. 2008-230108, filed Sep. 8, 2008, the entire contents of which are incorporated herein by reference.

TECHNICAL FIELD

The present invention relates to a thermal printer using thermal paper having a thermosensitive on both sides, and a method of controlling the thermal printer.

BACKGROUND

There is a conventional thermal printer, which is provided with a thermal head at positions corresponding to one side and the other side of thermal paper having a thermosensitive layer on both sides, and prints both sides of thermal paper by operating both thermal heads, or prints one side of thermal paper by operating one of the thermal heads (e.g., Jpn. PAT. Appln. KOKAI Publication No. 2001-71569).

High-sensitive and low-sensitive thermal paper can be set in the above thermal printers.

When high-sensitive thermal paper is set, a print image density may become too high and print quality is degraded. When low-sensitive thermal paper is set, a print image density may become too low and print quality is degraded.

To prevent degradation of print quality, a user is required to check an actually printed image and adjust a print density of a thermal head.

However, such adjustment of print density is very troublesome for the user.

SUMMARY

It is an object of the present invention to provide a thermal printer, which is configured to automatically set print density optimum for thermal paper at all times, and improves print quality, and a method of controlling the thermal printer.

A thermal printer according to an aspect this invention comprises: thermal paper, which has a thermosensitive layer on one side or both sides, and is fed in a predetermined direction; a first thermal head which prints one side of the thermal paper; a second thermal head which prints the other side of the thermal paper; a control section which selectively prints one side and the other side of the thermal paper with the first and second thermal heads; a first mark sensor which detects a mark printed on one side of the thermal paper; a second mark sensor which detects a mark printed on the other side of the thermal paper; a determination section which determines whether the thermal paper is double-side thermal paper printable on both sides or one-side thermal paper printable on only one side, according to the detection results of the first and second mark sensors; a detection section which detects a print density for the thermal paper according to the outputs of the first and second mark sensors; and an adjustment section which adjusts print densities of the first and second thermal heads, according to the detection results of the detection section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the invention will be explained hereinafter with reference to the accompanying drawings. First, a configuration of an essential part is shown in FIG. 1.

Figure 1:
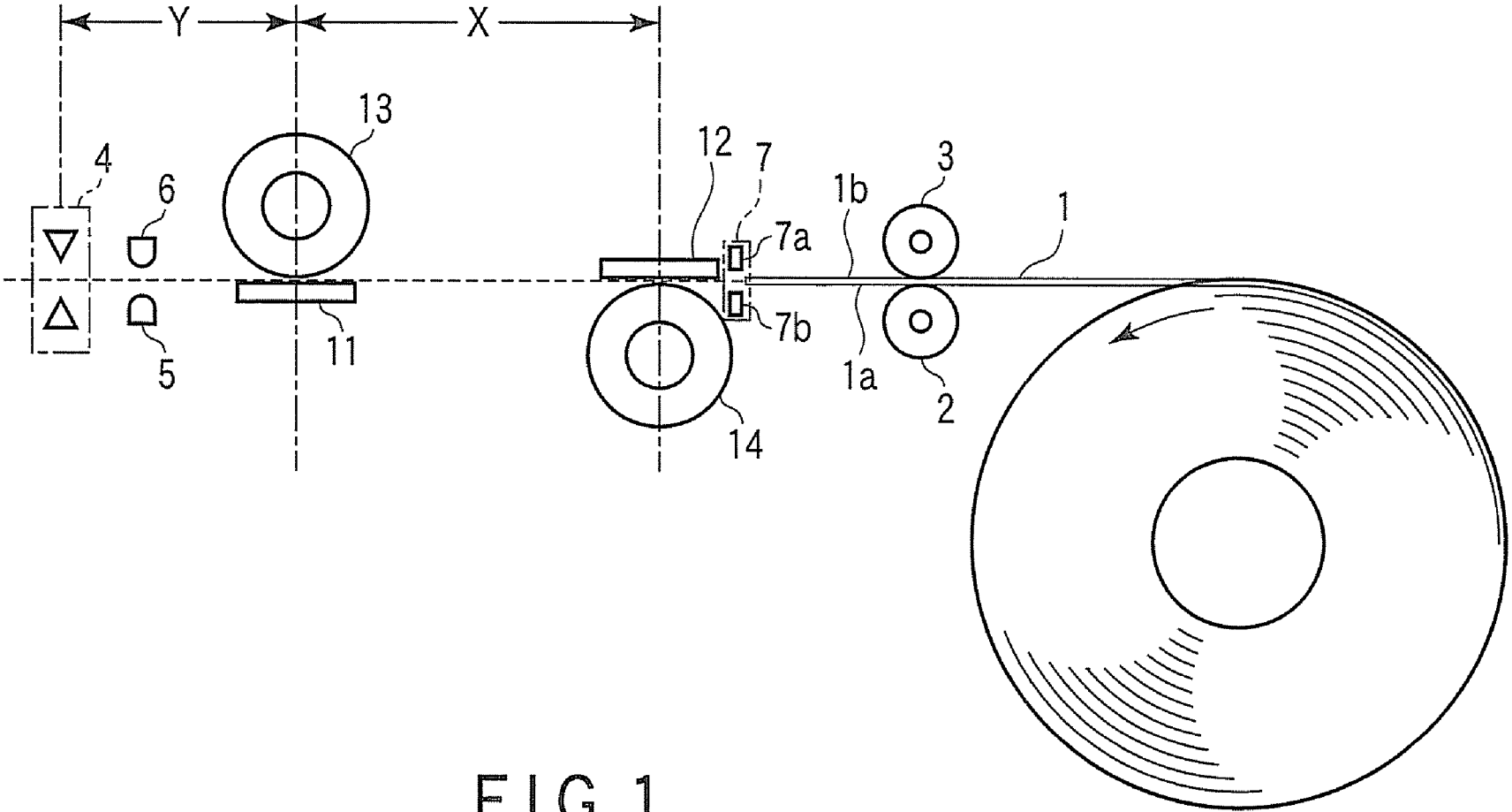
FIG. 1 is a diagram showing a configuration of an essential part of an embodiment of the invention.

In FIG. 1, a reference numeral 1 denotes thermal paper. The thermal paper 1 has a thermosensitive layer on one side (a front side) 1*a* and the other side (a back side) 1*b*. The rear end side of the thermal paper is wound like a roll with the front side 1*a* faced inside. When the thermal paper 1 is set in a paper setting unit, the front end is fed in a predetermined direction by paper-feeding rollers 2 and 3. The thermosensitive layers are made of material, which turns black or red, for example, when it is heated to a temperature higher than a predetermined value.

Along the feeding direction of the thermal paper 1, there are provided a first thermal head 11 which contacts the front side 1*a* of the thermal paper 1, and a second thermal head 12 which contacts the back side 1*b* of the thermal paper. The first and second thermal heads 11 and 12 are shaped to extend in the direction perpendicular to the thermal paper 1 feeding direction, or in the width direction of the thermal paper 1, and provided at positions apart from each other along the thermal paper 1 feeding direction. The first thermal head 11 is positioned in the downstream of the second thermal head 12 in the thermal paper 1 feeding direction. A first platen roller 13 is provided at a position opposite to the first thermal head 11 through the thermal paper 1, and a second platen roller 14 is provided at a position opposite to the second thermal head 12 through the thermal paper 1. A cutter 4 for cutting the thermal paper 1 is provided in the downstream of the first thermal head 11 in the paper-feeding direction.

The distance between the second thermal head 12 and first thermal head 11 is X, and the distance between the first thermal head 11 and the cutter 4 is Y.

First and second mark sensors 5 and 6 are provided between the first thermal head 11 and cutter 4. The first mark sensor 5 is a reflection type optical sensor, which emits light to the front side of the thermal paper 1, takes in a reflected light from the front side, and detects a front-side mark Ma printed on the front side of the thermal paper 1 as described later. The second mark sensor 6 is a reflection type optical sensor, which emits light to the back side of the thermal paper 1, takes in a reflected light from the back side, and detects a backside mark Mb printed on the back side of the thermal paper 1.

A paper sensor 7 is provided at a position before the second thermal head 12 in the thermal paper 1 feeding direction. The paper sensor 7 is a photocoupler, which comprises a light-emitting element 7*a* and a light-receiving element 7*b*, opposing each other through the thermal paper 1 feeding path, and detects whether the front end of the thermal paper 1 is set at a position (a home position) before the second thermal head 12, by changes in the light received by the light-receiving element 7*b*, which receives the light emitted from the light-emitting element 7*a*.

Figure 2:
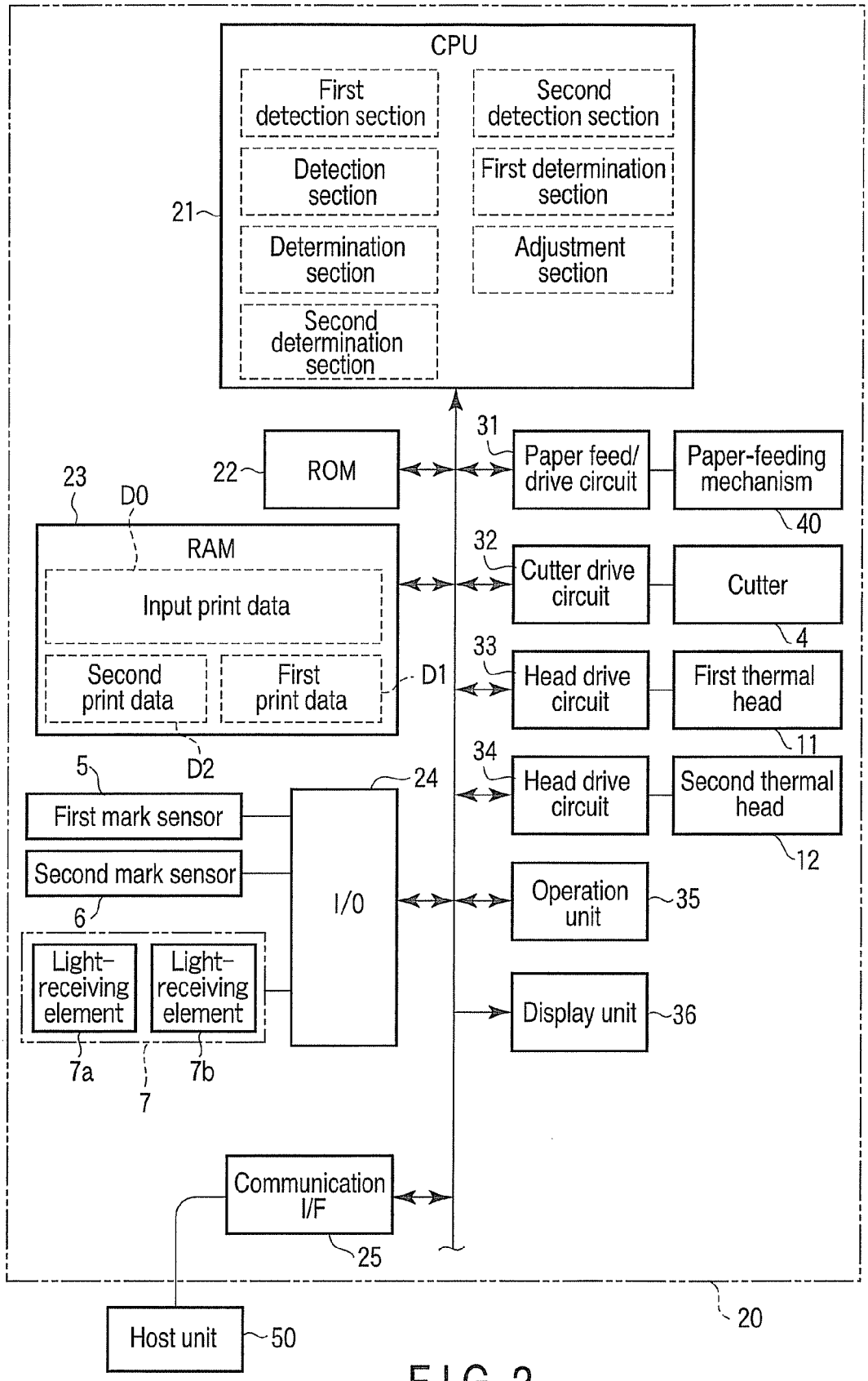
FIG. 2 is a block diagram of a control circuit of an embodiment of the invention.

FIG. 2 shows a control circuit of a thermal printer 20, which includes the configuration of FIG. 1. A main control unit CPU 21 is connected to a ROM 22 for storing a control program, a RAM 23 for storing data, an input/output unit (I/O) 24, a communication interface 25, a paper feed/drive circuit 31, a cutter drive circuit 32, head drive circuits 33 and 34, an operation unit 35 for setting operating conditions, and a display unit 36. The input/output unit 24 is connected to the first mark sensor 5, second mark sensor 6, and paper sensor 7. The communication interface 25 is connected to an external host unit 50. The paper feed/drive circuit 31 drives a paper-feeding mechanism, which includes the paper-feeding rollers 2 and 3. The cutter drive circuit 32 drives the cutter 4. The head drive circuits 33 and 34 drive the first and second thermal heads 11 and 12, respectively.

The CPU 21 has the following means (1) to (7) as primary functions.

(1) A first control section, which prints marks Ma and Mb described later on one side and the other side of the thermal paper 1, respectively, when the thermal paper 1 is set.

(2) A first detection section, which detects the printed marks Ma and Mb with first and second mark sensors 5 and 6, respectively.

(3) A first determination section, which determines whether the thermal paper 1 is double-side thermal paper printable on both sides, or one-side thermal paper printable on only one side, according to the detection results of the first and second mark sensors 5 and 6, when the thermal paper 1 is set. Specifically, the first determination section determines the thermal paper 1 to be double-side thermal paper, when both first and second mark sensors 5 and 6 detect marks. The first determination section determines the thermal paper 1 to be one-side thermal paper printable on only the front side 1*a*, when only the first mark sensor 5 detects a mark, and to be one-side thermal paper printable on only the back side 1*b*, when only the second mark sensor 6 detects a mark.

(4) A second detection section, which detects a print density for the thermal paper 1 according to the outputs of the first and second mark sensors 5 and 6, when the thermal paper 1 is set. Specifically, the second detection section detects a print density on the front side 1*a* of the thermal paper 1 according to the output of the first mark sensor 5, and detects a print density on the back side 1*b* of the thermal paper 1 according to the output of the second mark sensor 6.

(5) An adjustment section, which adjusts print densities of the first and second thermal heads 11 and 12 according to the detection results of the second detection section, when the thermal paper 1 is set. Specifically, the adjustment section adjusts the print density of the first thermal head 11 according to the print density on the front side 1*a*, out of the print densities detected by the detection means, and adjusts the print density of the second thermal head 12 according to the print density on the back side 1*b*.

(6) A second determination section, which determines the thermal paper 1 not to be thermal paper, when both first and second mark sensors 5 and 6 detect no marks, when the thermal paper 1 is set.

(7) A second control section, which inhibits further printing and informs the determination result and prohibition by the display of the display unit 36, when the second determination section determines the thermal paper 1 not to be thermal paper.

Figure 3:
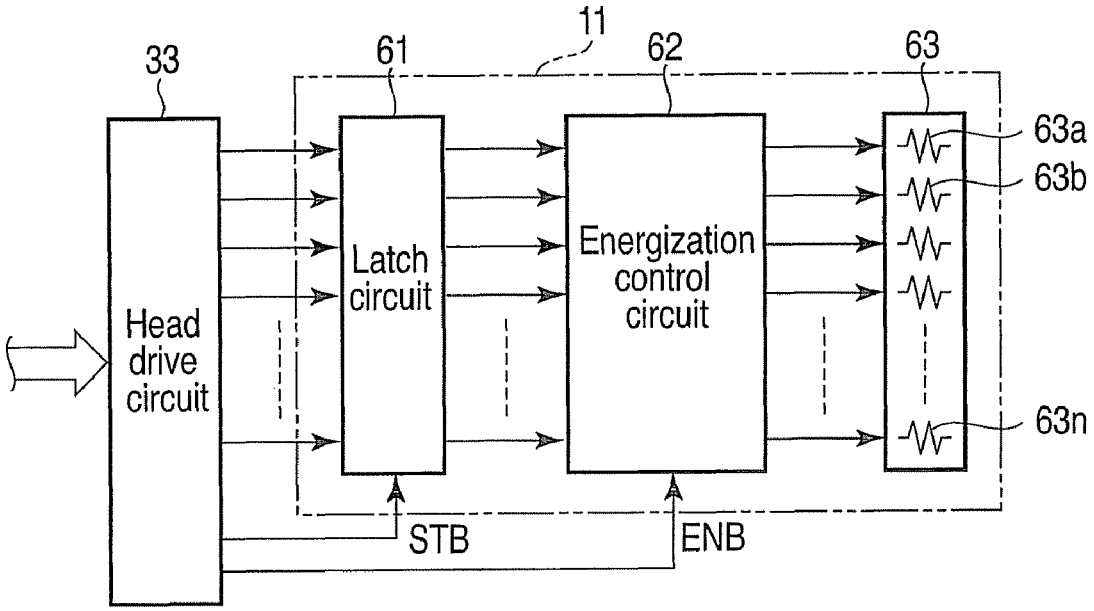
FIG. 3 is a block diagram showing a concrete configuration of a thermal head in an embodiment of the invention.

The first thermal head 11 comprises a latch circuit 61, an energization control circuit 62, and a heater unit 63, as shown in FIG. 3. The heater unit 63 has a number of linearly arranged heat transfer heating elements 63*a*, 63*b*, . . . 63*n*. The latch circuit 61 latches the first print data D1 supplied from the head drive circuit 33 for every line according to a strobe signal STB supplied from the head drive circuit 33. The energization control circuit 62 controls energization of the heating elements 63*a*, 63*b*, . . . 63*n* of the heater unit 63, according to the data in the latch circuit 61, at the timing when the enable signal ENB supplied from the head drive circuit 33 is activated. The second thermal head 12 has the same configuration as the first thermal head 11. An explanation thereof is omitted.

Figure 4:
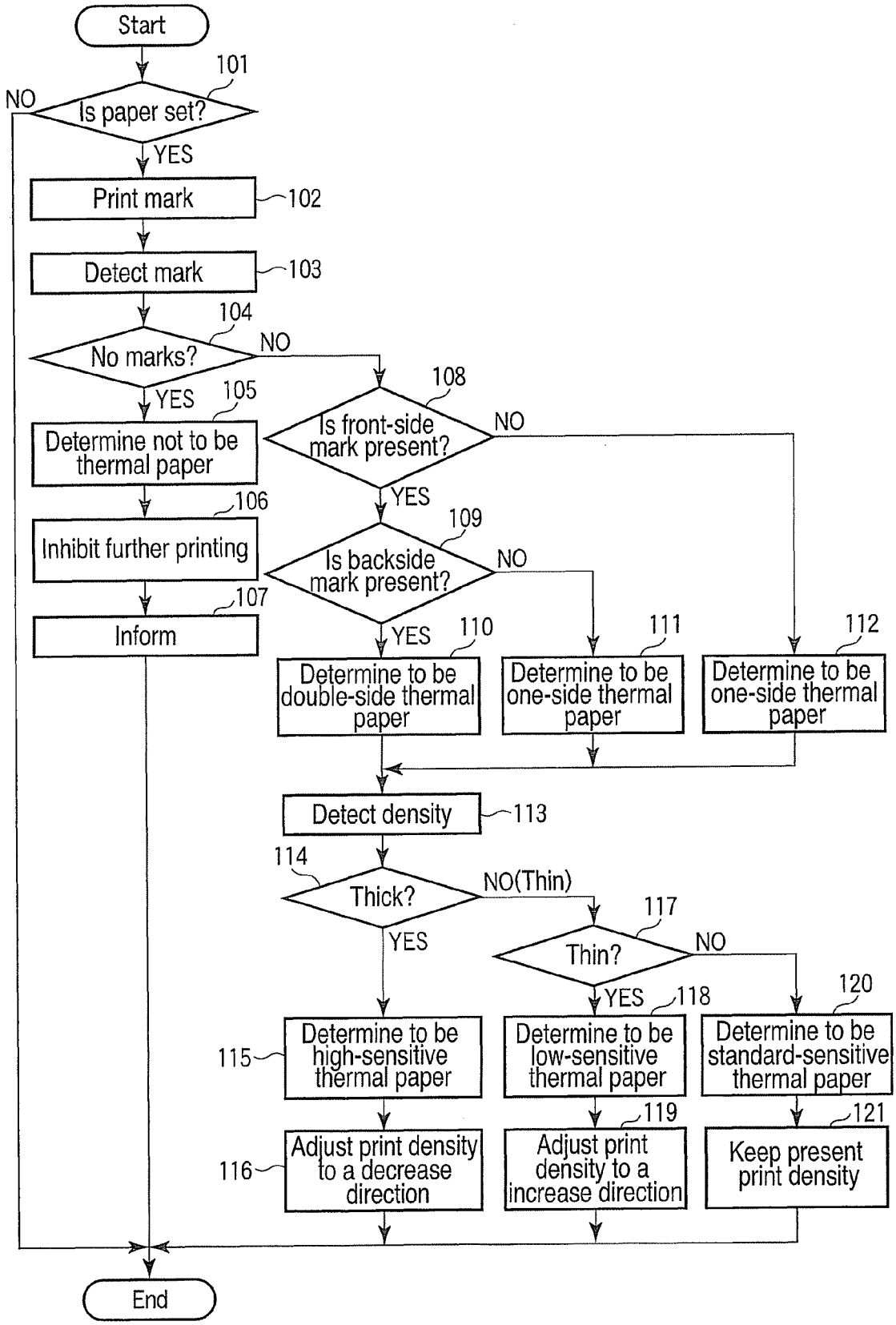
FIG. 4 is a flowchart for explaining operations of an embodiment of the invention.

Next, the functions of the embodiment will be explained with reference to the flowchart of FIG. 4.

Figure 5:
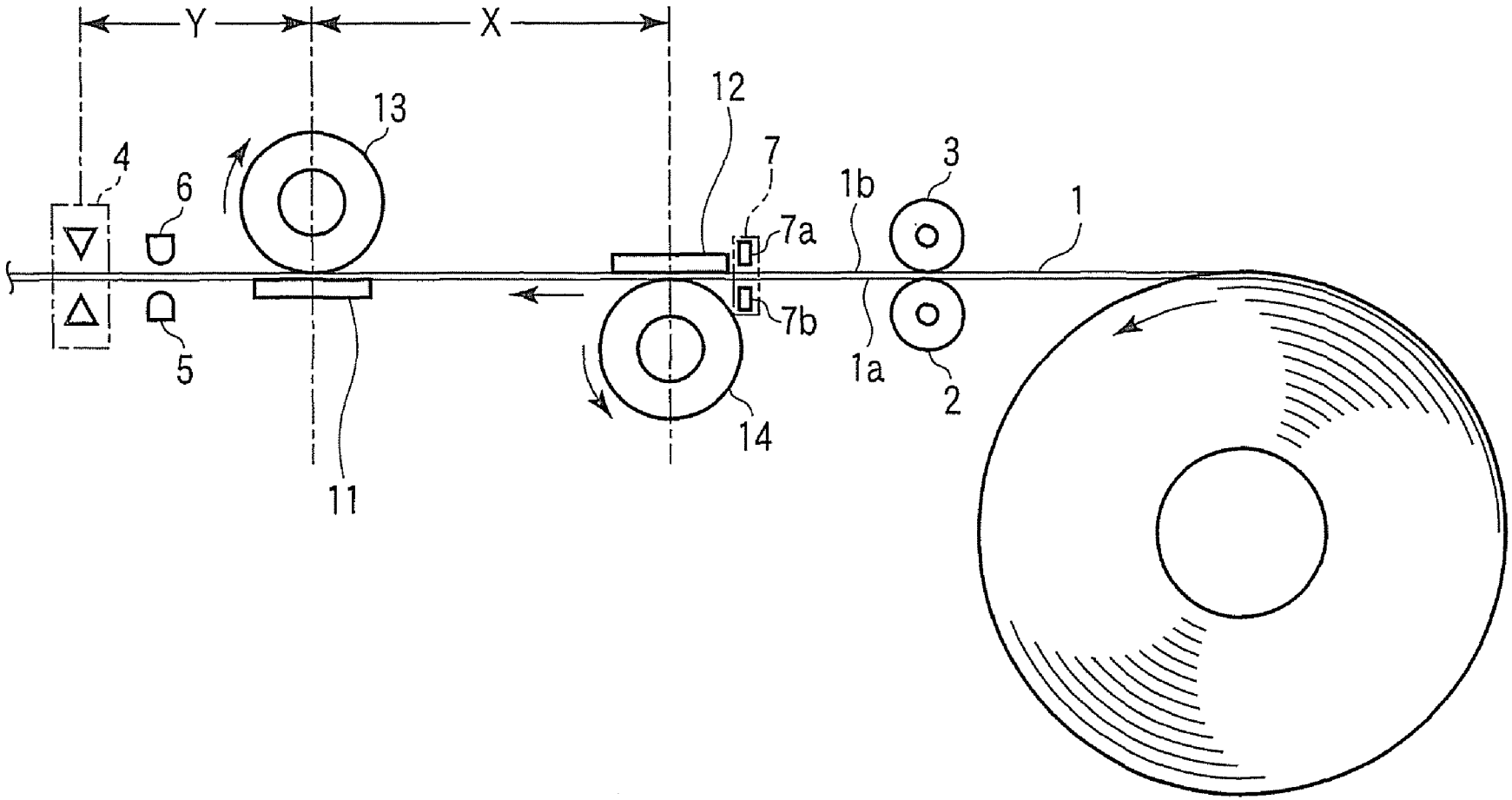
FIG. 5 is a diagram showing a state, in which the front end of thermal paper passes through first and second thermal heads in an embodiment of the invention.

When the thermal paper 1 is set in the thermal printer 20 (YES in step 101), the set thermal paper 1 is conveyed to the first and second thermal heads 11 and 12 as shown in FIG. 5.

Figure 6:
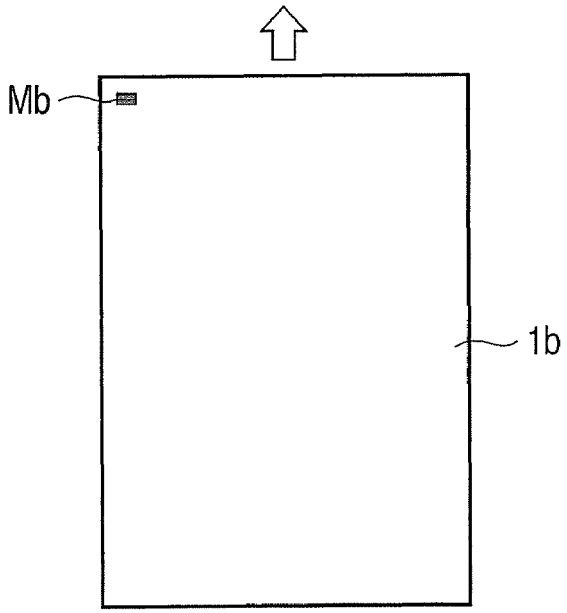
FIG. 6 is a diagram showing a state, in which a backside mark is printed on the back side of thermal paper in double-side printing in an embodiment of the invention.
Figure 7:
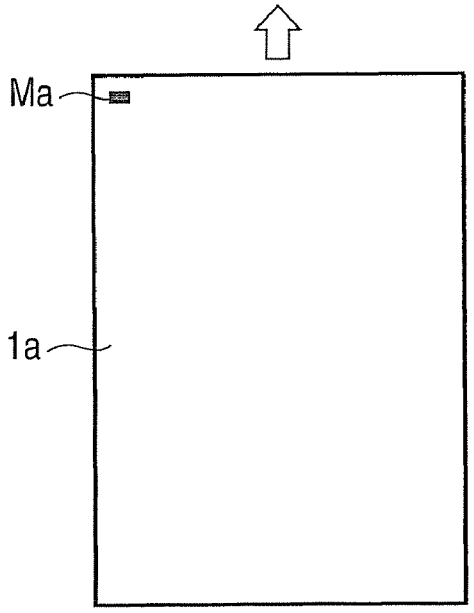
FIG. 7 is a diagram showing a state, in which a front-side mark is printed on the front side of thermal paper in double-side printing in an embodiment of the invention.

When the front end of the thermal paper 1 reaches the second thermal head 12, the second thermal head 12 prints a square black backside mark Mb at the front left side position on the back side 1*b* of the thermal paper 1, as shown in FIG. 6. Then, when the front end of the thermal paper 1 reaches the first thermal head 11, the first thermal head 11 prints a square black front-side mark Ma at the front left side position on the front side 1*b* of the thermal paper 1, as shown in FIG. 7 (step 102).

When the front end of the thermal paper 1 reaches the first and second mark sensors 5 and 6, the first and second mark sensors 5 and 6 detect the marks Ma and Mb printed on the front side 1*a* and back side 1*b* of the thermal paper 1 (step 103). After the front end of the thermal paper 1 passes through the positions corresponding to the first and second mark sensors 5 and 6, feeding of the thermal paper 1 is stopped, and the front end of the thermal paper 1 is returned to the position (home position) before the second thermal head 12, and set ready for printing, based on the detection result of the paper sensor 7.

Figure 8:
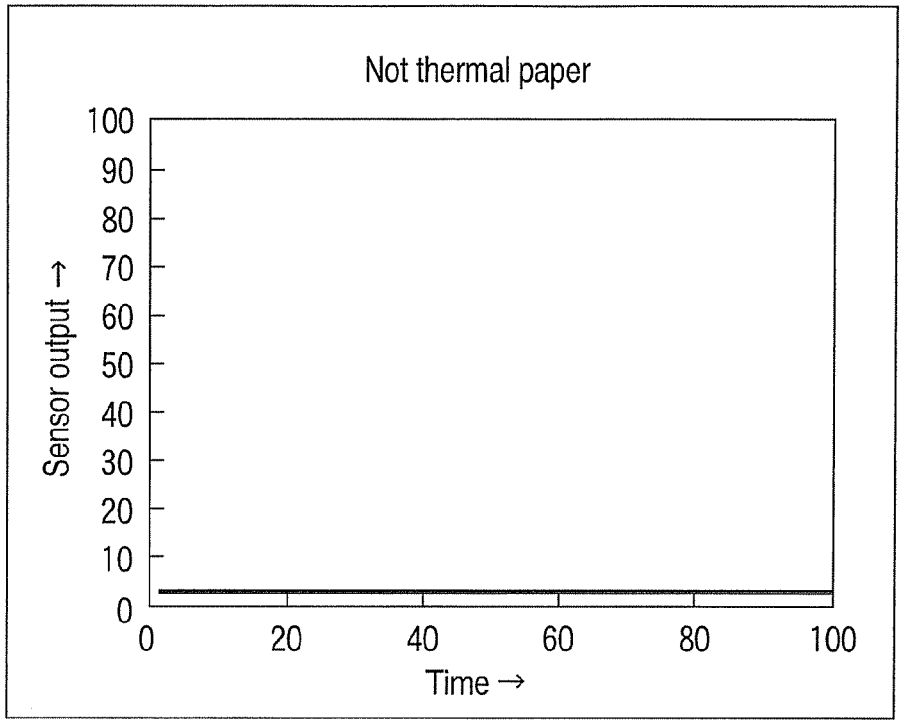
FIG. 8 is a diagram showing an example of sensor output, when thermal paper is plain paper in an embodiment of the invention.

When the first and second mark sensors 5 and 6 do not detect the marks Ma and Mb (YES in step 104), the set thermal paper 1 is determined not to be thermal paper (step 105). For example, if the set paper is plain paper having no thermosensitive layer, the marks Ma and Mb are not printed, and the outputs of the first and second mark sensors 5 and 6 are almost zero as shown in FIG. 8.

When the set paper is determined not to be thermal paper as described above, further printing is inhibited, and the determination result and inhibition is informed by the display of the display unit 36 (step 107). By this information, the user immediately knows that the paper set by the user is not the thermal paper 1, and can replace the paper by suitable thermal paper 1.

When the first mark sensor 5 detects the front-side mark Ma (NO in step 104, YES in step 108) and the second mark sensor 6 detects the backside mark Mb (YES in step 109), the set thermal paper 1 is determined to be double-side thermal paper (step 110). Thereafter, according to this determination result, double-side printing is executed with the first and second thermal heads 11 and 12.

When the first mark sensor 5 detects the front-side mark Ma (NO in step 104, YES in step 108) and the second mark sensor 6 does not detect the backside mark Mb (NO in step 109), the set thermal paper 1 is determined to be one-side thermal paper for the first thermal head 1 (step 111). Thereafter, according to this determination result, one-side printing is executed with the first thermal head 11.

When the first mark sensor 5 does not detect the front-side mark Ma and the second mark sensor 6 detects the backside mark Mb (NO in step 104, NO in step 108), the set thermal paper 1 is determined to be one-side thermal paper for the second thermal head 12 (step 112). Thereafter, according to this determination result, one-side printing is executed with the second thermal head 11.

When the thermal paper 1 is determined to be double-side thermal paper or when the thermal paper 1 is determined to be one-side thermal paper, a print density for the thermal paper 1 is detected based on the outputs of the first and second mark sensors 5 and 6 (step 113). In other words, when the thermal paper 1 is double-side thermal paper, a print density on the front side 1*a* of the thermal paper 1 is detected according to the output of the first mark sensor 5, and a print density on the back side 1*b* of the thermal paper 1 is detected according to the output of the second mark sensor 6. When the thermal paper 1 is one-side thermal paper for the first thermal head 11, a print density on the front side 1*a* of the thermal paper 1 is detected according to the output of the first mark sensor 5. When the thermal paper 1 is one-side thermal paper for the second thermal head 12, a print density on the back side 1*b* of the thermal paper 1 is detected according to the output of the first mark sensor 6.

Figure 9:
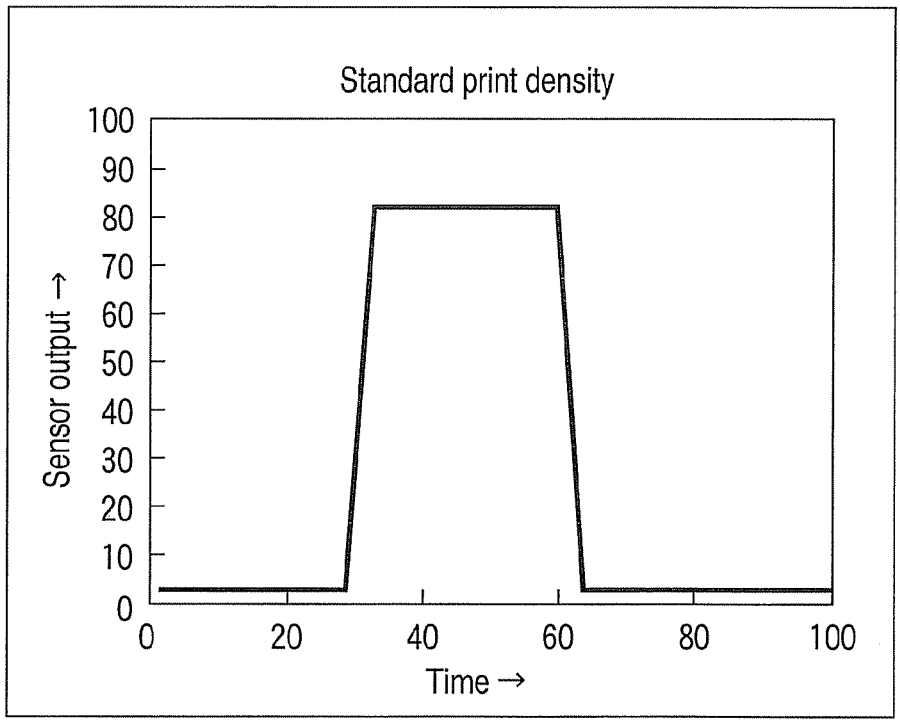
FIG. 9 is a diagram showing an example sensor output, when print density for thermal paper is standard in an embodiment of the invention.
Figure 10:
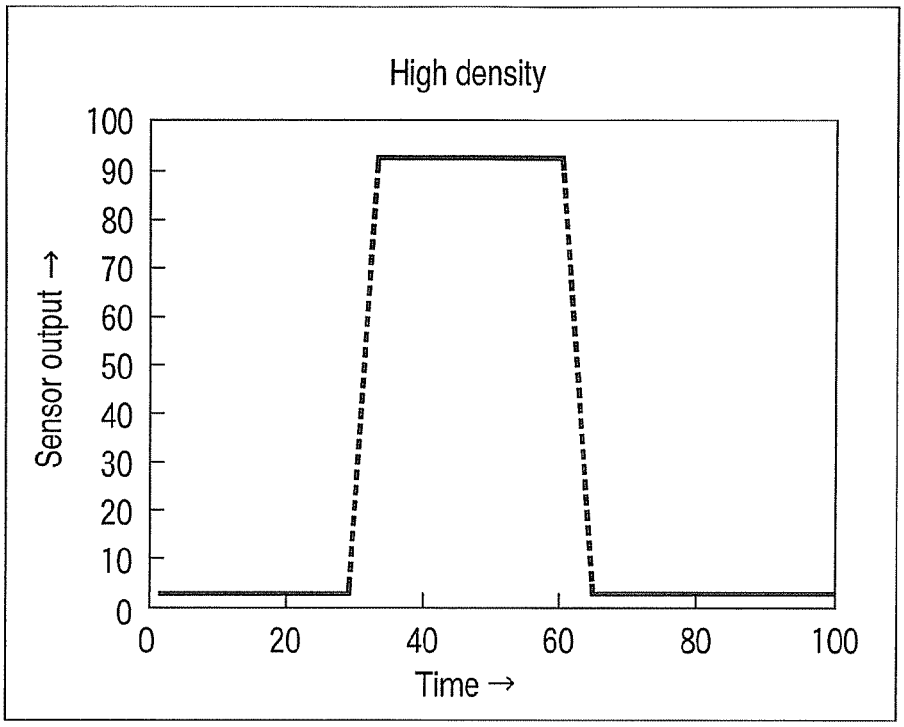
FIG. 10 is a diagram showing an example of sensor output, when print density for thermal paper is high in an embodiment of the invention.
Figure 11:
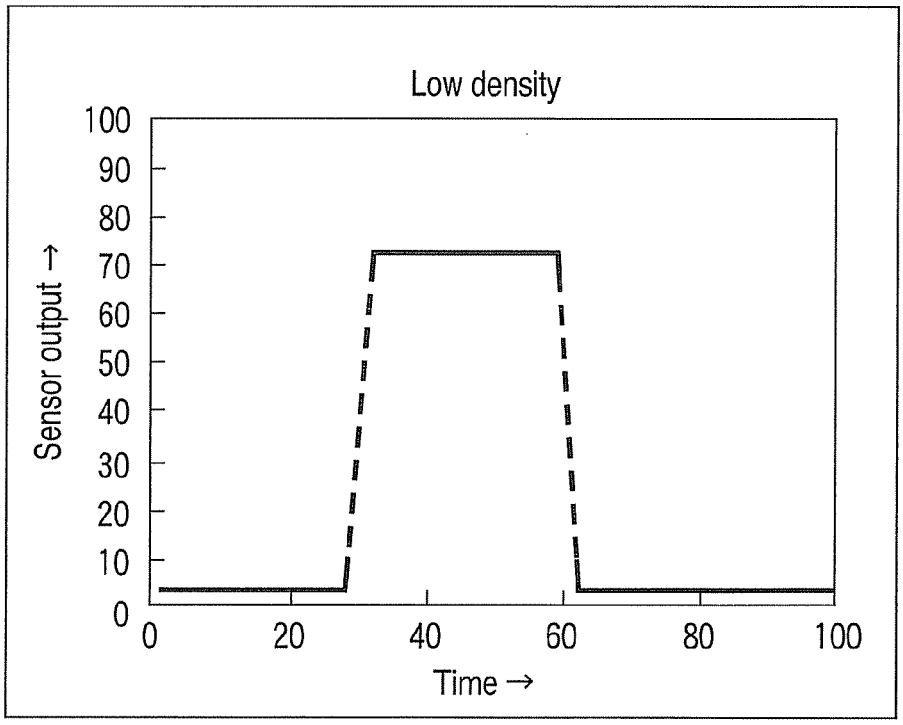
FIG. 11 is a diagram showing an example of sensor output, when print density for thermal paper is low in an embodiment of the invention.

FIGS. 9, 10 and 11 show examples of the outputs of the first and second mark sensor 5 and 6. When the output of the first mark sensor 5 is high level as shown in FIG. 10, a print density on the front side 1*a* is determined to be high (thick) (YES in step 114). When the output of the second mark sensor 6 is high level as shown in FIG. 10, a print density on the back side 1*b* is determined to be high (thick) (YES in step 114).

When the output of the first mark sensor 5 is low level as shown in FIG. 11, a print density on the front side 1*a* is determined to be low (thin) (YES in step 117). When the output of the second mark sensor 6 is low level as shown in FIG. 11, a print density on the back side 1*b* is determined to be low (thin) (YES in step 117).

When the output of the first mark sensor 5 is medium level between high and low as shown in FIG. 9, a print density on the front side 1*a* is determined to be standard (NO in step 114, NO in step 117). When the output of the second mark sensor 6 is medium level between high and low as shown in FIG. 9, a print density on the back side 1*b* is determined to be standard (NO in step 114, NO in step 117).

When the print density on the front side 1*a* is determined to be high (YES in step 114), the thermal paper 1 is determined to be high sensitive (step 115), and the print density of the first thermal head 11 is adjusted to a decrease direction (step 116).

When the print density on the back side 1*b* is determined to be high (YES in step 114), the thermal paper 1 is determined to be high sensitive (step 115), and the print density of the second thermal head 12 is adjusted to a decrease direction (step 116).

When the print density on the front side 1*a* is determined to be low (YES in step 117), the thermal paper 1 is determined to be low sensitive (step 118), and the print density of the first thermal head 11 is adjusted to a increase direction (step 119).

When the print density on the back side 1*b* is determined to be low (YES in step 117), the thermal paper 1 is determined to be low sensitive (step 118), and the print density of the second thermal head 12 is adjusted to a increase direction (step 119).

When the print density on the front side 1*a* is determined to be standard (NO in step 114, NO in step 117), the thermal paper 1 is determined to be standard sensitive (step 120), and the print density of the first thermal head 11 is kept at the present level (step 121).

When the print density on the back side 1*b* is determined to be standard (NO in step 114, NO in step 117), the thermal paper 1 is determined to be standard sensitive (step 120), and the print density of the second thermal head 12 is kept at the present level (step 121).

Figure 12:
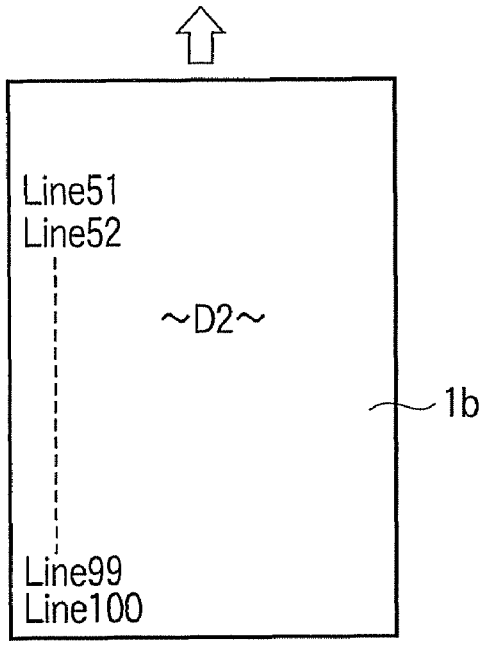
FIG. 12 is a diagram showing a state, in which print data D2 is printed on the back side of thermal paper in double-side printing in an embodiment of the invention.
Figure 13:
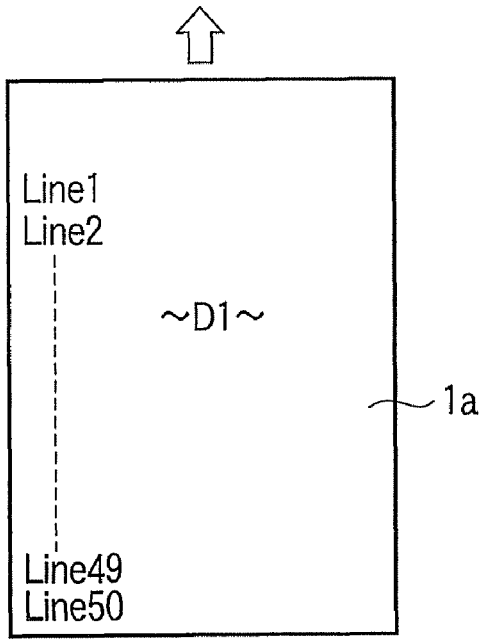
FIG. 13 is a diagram showing a state, in which print data D1 is printed on the front side of thermal paper in double-side printing in an embodiment of the invention.

The print data D0 supplied from the host unit 50 is divided into print data D1 and D2, and stored in the RAM 23. When the thermal paper 1 is double-side printing thermal paper, the print data D2 is printed on the back side 1*b* of the thermal paper 1 with the second thermal head 12 as shown in FIG. 12, and the print data D1 is printed on the front side 1*a* of the thermal paper 1 with the first thermal head 11 as shown in FIG. 13. When the thermal paper 1 is one-side printing thermal paper for the first thermal head 11, the print data D1 and D2 are printed on the front side 1*b* of the thermal paper 1 with the first thermal head 11. When the thermal paper 1 is one-side printing thermal paper for the second thermal head 12, the print data D1 and D2 are printed on the back side 1*b* of the thermal paper 1 with the second thermal head 12.

As described above, the print density for the thermal paper 1 is detected based on the outputs of the first and second mark sensors 5 and 6, and the print densities of the first and second thermal heads 11 and 12 are adjusted according to the detection results. A print density for thermal paper can be automatically set to optimum at all times without the user's operation. Therefore, the print quality and reliability of the thermal printer 20 are greatly improved.

Further, as the first and second mark sensors 5 and 6, which determine whether the thermal paper 1 is double-side printing paper or one-side printing paper, are used for detecting a print density, it is unnecessary to provide an additional unit for detecting a print density. This prevents increase in the cost.

In the embodiment described herein, the front-side mark Ma and backside mark Mb are printed at the front left side position in the thermal paper 1. The mark printing position is not limited to this, and may be appropriately selected considering the positions and relationship between the first and second mark sensors 5 and 6. A reflection type optical sensor is used as first and second mark sensors. The type of sensor is not limited to this, and may be appropriately selected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

thermal paper, which has a thermosensitive layer on one side or both sides, and is fed in a predetermined direction;

a first thermal head which prints one side of the thermal paper;

a second thermal head which prints the other side of the thermal paper;

a control section which selectively prints one side and the other side of the thermal paper with the first and second thermal heads;

a first mark sensor which detects a mark printed on one side of the thermal paper;

a second mark sensor which detects a mark printed on the other side of the thermal paper;

a determination section which determines whether the thermal paper is double-side thermal paper printable on both sides or one-side thermal paper printable on only one side, according to the detection results of the first and second mark sensors;

a detection section which detects a print density for the thermal paper according to the outputs of the first and second mark sensors; and an adjustment section which adjusts print densities of the first and second thermal heads, according to the detection results of the detection section.

2. The printer according to claim 1, wherein the first thermal head is positioned in the downstream of the second thermal head in the thermal paper feeding direction.

3. The printer according to claim 1, wherein the control section prints a mark on one side and the other side of the thermal paper with the first and second thermal heads, when the thermal paper is set, the determination section determines whether the thermal paper is double-side thermal paper printable on both sides or one-side thermal paper printable on only one side, according to the detection results of the first and second mark sensors, when the thermal paper is set, the detection section detects a print density for the thermal paper according to the outputs of the first and second mark sensors, when the thermal paper is set, and the adjustment section adjusts print densities of the first and second thermal heads, according to the detection results of the detection section, when the thermal paper is set.

4. The printer according to claim 1, wherein the determination section determines the thermal paper to be double-side thermal paper printable on both sides, when both first and second mark sensors detect marks, the determination section determines the thermal paper to be one-side thermal paper printable on only one side, when only the first mark sensor detects a mark, and the determination section determines the thermal paper to be one-side thermal paper printable on only the other side, when only the second mark sensor detects a mark.

5. The printer according to claim 1, wherein the detection section detects a print density on the front side of the thermal paper according to the output of the first mark sensor, and detects a print density on the back side of the thermal paper according to the output of the second mark sensor, and the adjustment section adjusts a print density of the first thermal head according to the print density on the front side, out of the print densities detected by the detection section, and adjusts a print density of the second thermal head according to the print density on the back side.

6. The printer according to claim 1, further comprising a determination section which determines the thermal paper not to be thermal paper, when both first and second mark sensors do not detect marks.

7. A thermal printer comprising:

thermal paper, which has a thermosensitive layer on one side or both sides, and is fed in a predetermined direction;

a first thermal head which prints one side of the thermal paper;

a second thermal head which prints the other side of the thermal paper;

control means for selectively printing one side and the other side of the thermal paper with the first and second thermal heads;

first mark sensing means for detecting a mark printed on one side of the thermal paper;

second mark sensing means for detecting a mark printed on the other side of the thermal paper;

determination means for determining whether the thermal paper is double-side thermal paper printable on both sides or one-side thermal paper printable on only one side, according to the detection results of the first and second mark sensing means;

detection means for detecting a print density for the thermal paper according to the outputs of the first and second mark sensing means; and adjustment means for adjusting print densities of the first and second thermal heads, according to the detection results of the detection means.

8. The printer according to claim 7, wherein the first thermal head is positioned in the downstream of the second thermal head in the thermal paper feeding direction.

9. The printer according to claim 7, wherein the control means printing a mark on one side and the other side of the thermal paper with the first and second thermal heads, when the thermal paper is set, the determination means determining whether the thermal paper is double-side thermal paper printable on both sides or one-side thermal paper printable on only one side, according to the detection results of the first and second mark sensing means, when the thermal paper is set, detection means detecting a print density for the thermal paper according to the outputs of the first and second mark sensing means, when the thermal paper is set, and adjustment means adjusting print densities of the first and second thermal heads, according to the detection results of the detection means, when the thermal paper is set.

10. The printer according to claim 7, wherein the determination means determining the thermal paper to be double-side thermal paper printable on both sides, when both first and second mark sensing means detecting marks, the determination means for determining the thermal paper to be one-side thermal paper printable on only one side, when only the first mark sensing means detecting a mark, and the determination means determining the thermal paper to be one-side thermal paper printable on only the other side, when only the second mark sensing means detecting a mark.

11. The printer according to claim 7, wherein the detection means detecting a print density on the front side of the thermal paper according to the output of the first mark sensing means, and detecting a print density on the back side of the thermal paper according to the output of the second mark sensing means, and the adjustment means adjusting a print density of the first thermal head according to the print density on the front side, out of the print densities detected by the detection means, and adjusting a print density of the second thermal head according to the print density on the back side.

12. The printer according to claim 7, further comprising determination means for determining the thermal paper not to be thermal paper, when both first and second mark sensing means do not detecting marks.

13. A method of controlling a thermal printer having:

thermal paper, which has a thermosensitive layer on one side or both sides, and is fed in a predetermined direction; a first thermal head which prints one side of the thermal paper; a second thermal head which prints the other side of the thermal paper; a control section which selectively prints one side and the other side of the thermal paper with the first and second thermal heads; a first mark sensor which detects a mark printed on one side of the thermal paper; a second mark sensor which detects a mark printed on the other side of the thermal paper; and a determination section which determines whether the thermal paper is double-side thermal paper printable on both sides or one-side thermal paper printable on only one side, according to the detection results of the first and second mark sensors;

the method comprising:

detecting a print density for the thermal paper according to the outputs of the first and second mark sensors; and adjusting print densities of the first and second thermal heads according to the detection results.

* * * * *